United States Patent [19]

Pennartz

[11] Patent Number: 4,961,865

[45] Date of Patent: Oct. 9, 1990

[54] COMBUSTION INHIBITING METHODS AND COMPOSITIONS

[75] Inventor: Edmond R. J. Pennartz, N. Vancouver, B.C., Canada

[73] Assignee: United American, Inc., Custer, Wash.

[21] Appl. No.: 319,750

[22] Filed: Mar. 6, 1989

Related U.S. Application Data

[63] Continuation-in-part of Ser. No. 292,417, Dec. 30, 1988.

[51] Int. Cl.[5] ..... A62D 1/00; A62C 1/00; A62C 3/00

[52] U.S. Cl. ..... 252/7; 169/45; 169/46; 252/2; 252/4; 252/603; 252/602; 252/607; 252/608

[58] Field of Search ..... 252/2, 47, 601, 602, 252/603, 607, 608; 169/45, 46; 8/490

[56] References Cited

U.S. PATENT DOCUMENTS

| | | | |
|---|---|---|---|
| 431,985 | 7/1990 | Martin | 252/2 |
| 641,801 | 1/1900 | Schroeter | 252/601 |
| 807,770 | 8/1968 | Galbraith | 252/2 |
| 836,265 | 11/1906 | Mayer | 252/2 |
| 1,076,762 | 10/1913 | Hall | 252/607 |
| 1,276,742 | 8/1918 | Ferguson | 252/2 |
| 1,451,485 | 4/1923 | Wootton | 252/601 |
| 1,716,476 | 6/1929 | Austin | 252/2 |
| 1,792,826 | 2/1931 | Dugas | 252/7 |
| 1,860,134 | 5/1932 | Brown | 252/607 |
| 2,388,014 | 10/1945 | Sargent et al. | 252/2 |
| 2,768,952 | 10/1956 | Anthony, Jr. et al. | 252/2 |
| 3,095,372 | 6/1963 | Cope | 252/2 |
| 3,673,088 | 6/1972 | Clements | 252/7 |
| 4,132,655 | 1/1979 | Draganov | 252/2 |
| 4,133,823 | 1/1979 | Joyce et al. | 252/601 |
| 4,289,662 | 9/1981 | Blasius | 252/607 |
| 4,313,761 | 2/1982 | Joyce et al. | 252/601 |

*Primary Examiner*—Howard J. Locker
*Attorney, Agent, or Firm*—Hughes & Multer

[57] ABSTRACT

Methods of and compositions for inhibiting the combustion of wood and other cellulosic materials. The material to be protected is impregnated with the composition which contains sodium chloride, magnesium chloride, sodium sulfate, sodium borate, and water. Optional constituents are calcium chloride, magnesium sulfate, magnesium bromide, and potassium chloride.

7 Claims, No Drawings

COMBUSTION INHIBITING METHODS AND COMPOSITIONS

RELATION TO PENDING APPLICATION

The present application is a continuation-in-part of application No. 292,417 pending filed Dec. 30, 1988 by Edmond Richard J. Pennartz for FIRE EXTINGUISHING COMPOSITIONS AND METHODS.

TECHNICAL FIELD OF THE INVENTION

The present invention relates to novel, improved compositions for inhibiting the combustion of cellulosic materials such as wood and to methods which employ the compositions discussed herein for that purpose.

BACKGROUND OF THE INVENTION

The copending application identified above discloses a new and novel class of fire extinguishing compositions which can also be employed to advantage to flameproof cellulosic materials such as wood, paper, and cardboard. These novel compositions contain sodium chloride, magnesium chloride, sodium sulfate, calcium chloride, and magnesium sulfate in an aqueous carrier and, optionally, one or more of the following compounds: calcium sulfate, potassium sulfate, magnesium bromide, and potassium chloride.

SUMMARY OF THE INVENTION

I have now discovered that the efficacy of these novel compositions in inhibiting the combustion of cellulosic materials such as wood can be significantly, and unexpectedly, increased by adding anhydrous borax (sodium borate, $Na_2B_4C_7$) to the composition.

An hydrous borax, in the amounts I employ, plays an effective combustion inhibiting role by melting and forming glasses when heated to temperatures in the range of 75–430° C. These glasses can spread over both internal and external surfaces of the protected material, thereby isolating the protected material from the oxygen required for combustion.

The sodium borate in the amount I employ also acts as an effective rust inhibitor. This is important in applications such as those involving buildings or structures with components joined together with nails, screws, and similar metallic fasteners which are susceptible to rusting. Structures protected in accord with the principles of the present invention are therefore less apt to fail because of rusted fasteners than those employing conventional nails, mild steel screws, and the like.

Protection against fungal attack is also provided by employing sodium borate in the novel compositions disclosed herein. This is an important advantage of the present invention as wood and other cellulosic materials are highly susceptible to fungal attack, especially in environments where high humidity and/or other moisture prevails, particularly if warm temperatures are also present.

Despite the inclusion of the the sodium borate, the novel compositions disclosed herein retain the desirable properties of the related compositions disclosed in the parent application. For example, they are cost effective and have a low enough level of toxicity that they can be handled and applied without taking elaborate safety precautions.

The novel compositions of the present invention are employed by applying them to the material to be protected. Anhydrous borax has detergent properties and promotes the penetration of the compositions into the material to be protected. This is important as penetration is an important factor in the protection afforded by a combustion inhibiting composition.

OBJECTS OF THE INVENTION

From the foregoing, it will be apparent to the reader that one important and primary object of the present invention resides in the provision of novel, improved methods of and compositions for inhibiting the combustion of cellulosic materials such as wood.

Other primary and important objects of the invention reside in the provision of methods and compositions as described in the preceding paragraph which are functionally and cost effective and can be safely employed without taking elaborate safety precautions.

Still other important and primary objects of the invention reside in the provision of combustion inhibiting compositions as characterized by the preceding objects which also provide protection against rust and fungal attack.

Other important objects and features of the invention will be apparent to the reader from the foregoing, the appended claims, and the ensuing detailed description and discussion of the invention.

DETAILED DESCRIPTION OF THE INVENTION

As described above, the novel combustion inhibiting compositions of the present invention have an aqueous carrier and the following, additional, essential ingredients:

Sodium Chloride
Magnesium Chloride
Sodium Sulfate (preferably in the decahydrate form)
Magnesium Sulfate
Sodium Borate (anhydrous borax)
Optional ingredients are:
Calcium Chloride
Magnesium Bromide
Potassium Chloride.

My novel combustion inhibiting compositions are formulated as follows:

| Constituent | Percent by Weight |
|---|---|
| Sodium Chloride | 2 to 28 |
| Magnesium Chloride | 7 to 16 |
| Sodium Sulfate | 1 to 10 |
| Sodium Borate | 3 to 20 |
| Calcium Chloride | 0 to 16 |
| Magnesium Sulfate | 0 to 8 |
| Magnesium Bromide | 0 to 10 |
| Potassium Chloride | 0 to 7 |
| Water | Balance. |

It is important that the concentration of solids in the composition be in the range of 10 to 14 weight percent.

Concentrations of the essential ingredients below the lower limits identified above are apt to result in compositions which are of greatly reduced effectiveness, if active at all. Above the stated maximum concentration, the essential and optional constituents at best increase the cost of the composition without any significant increase in effectiveness. In the worst cases, there is an antagonistic effort so that the compositions actually become less effective if the stated maximum amounts of constituents are exceeded.

One representative and presently preferred formulation is:

| Constituent | Percent by Weight |
|---|---|
| Sodium Chloride | 10.5 |
| Magnesium Chloride | 7.0 |
| Sodium Sulfate Decahydrate | 1.5 |
| Calcium Chloride | 0.6 |
| Magnesium Sulfate | 0.4 |
| Sodium Borate | 4.5 |
| Magnesium Sulfate | 0.4 |
| Potassium Sulfate | 0.3 |
| Magnessium Bromide | 0.7 |
| Potassium Chloride | 0.5 |
| Water | 74. |

At 20° C, the specific gravity of the compositions was 1.25, and the pH was 7.8.

The potassium sulfate in the foregoing compositions was employed in an amount and for the purposes discussed in parent application No. 292,417.

The combustion inhibiting compositions disclosed herein may be applied to the material by any desired technique—for example by brushing, spraying, dipping, or drenching. Application rates will vary, depending upon the precise formulation of the fire retardant composition, the particular material being treated, and whether or not pressure is used to increase the depth of penetration of the composition. In one application of the invention described hereinafter and designed to confirm the efficacy of the invention, 9.5 liters of the composition were applied in spray form to a crib constructed in accord with British Standard 5423 (1980) except for identified modifications. Suitable application rates for other applications of the invention can be readily ascertained.

The essential and optional constituents of the herein disclosed fire retardant compositions are employed for the following purposes:

SODIUM CHLORIDE

At elevated temperatures, halogen ($C1^-$) ions are released from this constituent of the fire extinguishing composition. These ions combine with oxygen in the ambient surroundings. This promotes the effectiveness of the composition as the thus combined oxygen is not available to support the combustion process.

Furthermore, as the aqueous phase of the composition evaporates, a solid sodium chloride residue is formed on the surface of the combustible material. This residue tends to seal the pores in the surface of the combustible material. The consequence is that oxygen cannot penetrate beyond the surface of the combustible material, and recognition is thereby inhibited.

MAGNESIUM CHLORIDE

This constituent of the novel, herein disclosed combustion inhibiting compositions markedly increases the ability of the formulation to penetrate beyond the surface of the material to be protected, thereby increasing its effectiveness. Further, because of its magnesium ion ($Mg^{++}$) content, this constituent adds a flameproofing capability to the compositions in which it is incorporated.

HYDRATED SODIUM SULFATE

This constituent is typically supplied as the decahydrate, a compound with the formula $Na_2SO_4 10H_2O$.

The chemically bound water of the hydrated sodium sulfate is released only at temperatures at, or above, 100° C. Thus, this chemically bound water does not evaporate but remains available and releasable at an elevated temperature to cool the protected material and keep it from igniting under conditions in which combustion would otherwise occur.

Furthermore, sodium sulfate decahydrate is capable of absorbing seven times as much thermal energy as its prior art counterparts Thus, by employing this constituent, one can materially increase the thermal energy absorptability of the combustion inhibiting compound without increasing the dissolved solids content of the composition.

MAGNESIUM SULFATE

This constituent of the novel combustion inhibiting compositions disclosed herein has a significant flameproofing or fireproofing capability.

SODIUM BORATE

This compound forms glasses when heated, thereby protecting the treated material by denying the oxygen required for combustion to it. Also, this constituent of the novel combustion inhibiting compositions disclosed herein is a rustproofing agent and a fungicide; and it increases the effectiveness of these compositions by increasing their ability to penetrate beneath the surfaces of, and into, the materials to which they are applied.

CALCIUM CHLORIDE

Appropriate amounts of calcium chloride (identified above) keep the fire extinguishing compositions of the present invention from freezing, even at temperatures which are well below 0° C. This is important in that the herein disclosed fire extinguishing compositions can consequently be applied essentially in all climatic zones and during all seasons of the year.

Another important advantage of incorporating calcium chloride in the combustion inhibiting compositions of the present invention is that this compound has a demonstrable and significant ability to bind together the fine, airborne particles of soot or carbon which are generated by the combustion of organic materials. This ability to agglomerate airborne carbon particles is important in that, to the extent that there is combustion of the protected material, soot particles that are thereby generated will be agglomerated; and the agglomerated soot particles quickly settle out of the ambient atmosphere, keeping them from being inhaled and causing injury or even death.

In this respect, actual testing has shown that as much as fifteen to twenty percent of the soot particles given off by burning material can be agglomerated and thereby eliminated as a health hazard by incorporating calcium chloride in compositions akin to those disclosed herein.

MAGNESIUM BROMIDE

This optional constituent of the herein disclosed fire extinguishing compositions compliments the previously discussed sodium chloride constituent. In particular, both compositions release halide ions at elevated temperatures; and, as discussed above, those ions have fire combatting properties in that they combine with oxygen in the surrounding atmosphere and make that oxygen unavailable to the combustion process. The halide ($C1^{31}$) ions of the sodium chloride are released at a temperature of approximately 170° C. whereas the corresponding ions ($Br^-$) of the magnesium bromide do not become available until a temperature of about 750° C. is reached. At this point, the supply of available chloride ions will typically have been exhausted. Thus, as indicated above, the magnesium bromide supports or complements the action of the sodium chloride by continuing the supply of oxygen depleting halide ions beyond the point at which such ions are available from the essential, sodium chloride constituent of the composition.

It is to be noted, in conjunction with the foregoing, that the concentrations of bromide ions released from the magnesium bromide are well within TLV guidelines. In particular, the herein disclosed compositions make available a maximum of three ppm/$m^3$ of bromide ion whereas the TLV guidelines permit a maximum of 5 ppm/$m^3$.

POTASSIUM CHLORIDE

This optional constituent is employed, as necessary, to buffer or raise the total pH of a combustion inhibiting composition as disclosed herein to approximately 6.8–7.8. It is important that the pH of the composition be in this range to prevent injury if it comes into contact with skin or other tissue of persons handling the composition.

As was pointed out above, one important advantage of the present invention is that the novel fire extinguishing compositions disclosed herein have low levels of toxicity. Toxicity data on the essential and optimal constituents of these compositions follows:

| Sodium Chloride (NaCl) | | |
|---|---|---|
| CAS RN: 7647145 | | |
| NIOSH #: VZ 4725000 | | |
| Toxicity Data: 2 | | |
| $LD_{50}$ | orl - rat | 3000 mg/kg |
| $LD_{50}$ | scu - rat | 3500 mg/kg |
| $LD_{50}$ | orl - mus | 4000 mg/kg |
| $LD_{50}$ | ipr - mus | 2602 mg/kg |
| $LD_{50}$ | scu - mus | 3150 mg/kg |
| $LD_{50}$ | ivn - mus | 645 mg/kg |
| $LD_{50}$ | ipr - dog | 364 mg/kg |
| | skn - rbt | 50 mg/24H = MLD |
| | skn - rbt | 500 mg/24H = MLD |
| | eye - rbt | 100 mg = MLD |
| | eye - rbt | 100 mg/24H = SEV |

Ingestion of large amounts of sodium chloride can cause irritation of the stomach.

| Sodium Chloride (NaCl) | | |
|---|---|---|
| CAS RN: 7647145 | | |
| NIOSH #: VZ 4725000 | | |
| Toxicity Data: 2 | | |
| $LD_{50}$ | orl - rat | 3000 mg/kg |
| $LD_{50}$ | scu - rat | 3500 mg/kg |
| $LD_{50}$ | orl - mus | 4000 mg/kg |
| $LD_{50}$ | ipr - mus | 2602 mg/kg |
| $LD_{50}$ | scu - mus | 3150 mg/kg |
| $LD_{50}$ | ivn - mus | 645 mg/kg |
| $LD_{50}$ | ipr - dog | 364 mg/kg |
| | skn - rbt | 50 mg/24H = MLD |
| | skn - rbt | 500 mg/24H = MLD |
| | eye - rbt | 100 mg = MLD |
| | eye - rbt | 100 mg/24H = SEV |

The fatal dose of orally ingested boron compounds such as boric acid for an adult is somewhat more than 15 or 20 g and for an infant from 5 to 6 g.

| Calcium Chloride ($CaCl_2$) | | |
|---|---|---|
| CAS RN: 10043524 | | |
| NIOSH #: EV 9800000 | | |
| Toxicity Data: 3-2 | | |
| $LD_{50}$ | orl - rat | 1000 mg/kg |
| $LD_{50}$ | ims - rat | 25 mg/kg |
| $LD_{50}$ | ipr - mus | 280 mg/kg |
| $LD_{50}$ | ivn - mus | 42 mg/kg |

Reported in EPA TSCA Inventory 1980

| Sodium Sulfate ($Na_2SO_4$) | | |
|---|---|---|
| CAS RN: 7767826 | | |
| NIOSH #: WE 1650000 | | |
| Toxicity Data: 2-1 | | |
| $LD_{50}$ | orl - mus | 5989 mg/kg |
| LDLo | ivm - mus | 1220 mg/kg |
| LDLo | ivn - rbt | 4470 mg/kg |

Reported in EPA TSCA Inventory 1980
THR: MOD ivn, LOW orl,ivn
The fatal dose of orally ingested boron compounds such as boric acid for an adult is somewhat more than 15 or 20 g and for an infant from 5 to 6 g.

| Magnesium Sulfate ($MgSO_4$) + Magnesium Bromide ($MgBr_2$) | | |
|---|---|---|
| CAS RN: 7847889 | | |
| NIOSH #: OM 4500000 | | |
| Toxicity Data: 2-1 | | |
| $LD_{50}$ | scu - mus | 980 mg/kg |

Reported in EPA TSCA Inventory 1980 THR: MOD scu,ipr,ivn, orl; LOW orl

| Potassium Chloride (KCl) | | |
|---|---|---|
| CAS RN: 7447407 | | |
| NIOSH #: TS 8050000 | | |
| Toxicity Data: 3-2 | | |
| $LD_{50}$ | ipr - rat | 660 mg/kg |
| $LD_{50}$ | ivn - rat | 39 mg/kg |
| $LD_{50}$ | orl - mus | 383 mg/kg |
| $LD_{50}$ | orl - gpg | 2500 mg/kg |

Tosicologie Review: INTEAG (15(1),7.47,27ATAP 3,118,69 Reported in EPA TSCA Inventory 1980 THR: An eye irritant. Large oral doses cause gastrointestinal irritation, purging, weakness, and circulatory problems. Also, potassium chloride affects the blood picture.

The efficacy of the compositions disclosed herein was demonstrated by tests in which the fire retardation characteristics of the representative formulation identified above was compared with the fire retardant properties of water. Particulars follows.

EQUIPMENT AND FIRE RETARDANT COMPOSITIONS

EQUIPMENT

A 9.5 liter, Amerex Model 240, 9.5 liter water, stored-pressure fire extinguisher with a standard jet nozzle was used. The Amerex extinguisher was listed as approved by The Loss Prevention Council under FOC approval scheme with a B.S. 5423: 1980 Class A test fire rating of 13A.

Seventy-five liters of the composition (Ultraflex) was provided. It had a specific gravity of 1.25 to 1.28 and a freezing point of −10° C.

TEST PROGRAM

Three burnback tests were carried out on modified 13A test fires with timber treated as follows:

(a) saturated with 9.5L of Ultraflamex, application by means of the merex extinguisher.

(b) saturated with 9.5L of water, application as in (a) above.

(c) untreated, natural state, moisture content approximately 15 percent.

In each test, the 13A crib was modified by reducing the number of layers from fourteen to eight. The center transverse stick of the top layer was removed to provide a fire break/fire development indicator. Each crib was ignited with 2.2 liters of heptane contained in a tray, 60mm×40mm×100mm, positioned with one of its long sides 150mm in from the crib support stand so that the tray was partly beneath the crib.

The tray of heptane beneath the treated cribs was ignited within 45 seconds of completing the treatment ((a) or (b) above.

After ignition the heptane was allowed to burn until exhausted, giving a pre-burn time of approximately 4 minutes 45 seconds. The subsequent development of each fire was observed and recorded.

Results

ULTRAFLAMEX TREATED TIMER

The crib for this test was allowed to burn freely for 30 minutes after the pre-burn periods at which point the test was terminated. The crib retained its integrity. About 40 percent of its length has been involved in fire; i.e., damaged by burning or charring. In plan view, the flame front was parabolic in shape.

The appropriate average rate of the spread of flame along the top layer of the crib was 19mm/minute.

| Time (post pre-burn) min:sec | Observations |
|---|---|
| 5:00 | 3rd stick of top layer partially engulfed with flame, |
| 6:20 | 3rd stick of top layer completely engulfed with flame/4th stick ignited, |
| 10:00 | Approxiately 25 percent of crib length fire-involved, |
| 13:50 | 5th stick of top layer ignited, |
| 14:15 | 4th stick of top layer completely engulfed with flame, |
| 20:08 | Center longitudinal support stick collapsed, |
| 23:00 | 2nd longitudinal support stick collapsed, |
| 25:00 | Approxately 30 percent of crib length fire-involved, |
| 25:30 | 5th stick of top layer engulfed in flame/6th stick ignited, |
| 28:48 | 3rd longitudinal support stick collapsed, |
| 30:00 | Test terminated. |

WATER-TREATED TIMBER

The crib for this test collapsed at 14 minutes 36 second. At this point, approximately 50 percent of its length had become involved in fire. In plan view, the flame front was a shallow curve.

The appropriate average rate of the spread of flame along the top layer was 25mm/minute.

Significant events during the test:

| Time (post pre-burn) min:sec | Observations |
|---|---|
| 3:15 | Approximately 25 percent of crib length fire-involved, |
| 5:10 | 4th stick of top layer engulfed in flames/5th stick ignited, |
| 9:25 | 5th stick of top layer engulfed in flames/6th stick ignited, |
| 12:52 | Center longitudinal support stick collapsed, |
| 13:00 | 2nd longitudinal support stick collapsed, |
| 13:35 | 3rd longitudinal support stick collapsed, |
| 14:36 | Crib collapsed. |

Untreated Timber

The crib for this test collapsed at 14 minutes 47 seconds. At this point, approximately 90 percent of its length had become involved in the fire. In plan view, the flame front was virtually a straight line across the crib.

The approximate average rate of the spread of flame along the top layer was 45mm/minute.

Significant events during the test:

| Time (post pre-burn) min:sec | Observations |
|---|---|
| 2:00 | 6th stick of top layer ignited, |
| 4:50 | 6th stick of top layer engulfed in flames, |
| 5:18 | Fire break bridged; i.e., 8th stick of top layer ignited, |
| 8:00 | 9th stick of top layer ignited, |
| 9:40 | Center longitudinal support stick collapsed, |
| 10:05 | 10th stick of top layer ignited, |
| 10:12 | 2nd longitudinal support stick collapsed, |
| 11:35 | 3rd longitudinal support stick collapsed, |
| 12:30 | Approxiately 75 percent of crib length fire-involved/11th stick of top layer ignited, |
| 13:50 | 12th stick of top layer ignited, |
| 14:47 | Crib collapsed. |

CONCLUSION

Ultraflex, when used in an Amerex Model 240 fire extinguisher achieved a B.S. 5423: 1980, Class A test fire rating of 27A.

This is a considerable enhancement of extinguishing efficiency over water, as the highest rating previously achieved, volume for volume, was 13A.

In addition to the enhancement of extinguishing ability the agent also offered a degree of fire retardancy greater than that inherent in water.

The invention may be embodied in forms other than those disclosed above without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

I claim:

1. A fire extinguishing composition formulated as follows:

| Constituent | Percent by Weight |
|---|---|
| Sodium Chloride | 2 to 28 |
| Magnesium Chloride | 7 to 16 |
| Sodium Sulfate Decahydrate | 1 to 10 |
| Sodium Borate | 3 to 20 |
| Calcium Chloride | 0 to 16 |
| Magnesium Sulfate | 0 to 8 |
| Magnesium Bromide | 0 to 10 |
| Potassium Chloride | 0 to 7 |
| Water | Balance. |

2. A combustion inhibiting composition as defined in claim 1 which has a pH in the range of 6.8 to 7.8.

3. A combustion inhibiting composition as defined in claim 1 in which the total concentration of non-aqueous constituents is in the range of 10 to 14 weight percent.

4. A method of protecting a cellulosic material against combustion which includes the step of impregnating said material with a combustion inhibiting composition formulated as follows:

| Constituent | Percent by Weight |
|---|---|
| Sodium Chloride | 2 to 28 |
| Magnesium Chloride | 7 to 16 |
| Sodium Sulfate | 1 to 10 |
| Calcium Chloride | 0 to 16 |
| Magnesium Sulfate | 0 to 8 |
| Sodium Borate | 3 to 20 |
| Magnesium Bromide | 0 to 10 |
| Potassium Chloride | 0 to 7 |
| Water | Balance. |

5. A method as defined in claim 4 in which the combustion inhibiting position has a pH in the range of 6.8 to 7.8.

6. A method as defined in claim 4 in which the total concentration of non-aqueous constituents in the combustion inhibiting composition is in the range of 10 to 14 weight percent.

7. A method as defined in claim 4 in which the cellulosic material is a wood.

* * * * *

UNITED STATES PATENT AND TRADEMARK OFFICE
CERTIFICATE OF CORRECTION

PATENT NO. : 4,961,865
DATED : 09 October 1990
INVENTOR(S) : Edmond R.J. Pennartz

It is certified that error appears in the above—identified patent and that said Letters Patent is hereby corrected as shown below:

Column 3, line 54, change "recognition" to --reignition--.

Column 4, line 9, after "counterparts" insert a --period--.

Column 4, line 68, change "($Cl^{31}$)" to --($Cl^{-}$)--.

Column 5, line 32, change "optimal" to --optional--.

Column 5, replace lines 54-68 with:

--Magnesium Chloride ($MgCl_2$)

CAS RN: 7786303

NIOSH #: 2800000

Toxicity Data: 3-2

| | | | |
|---|---|---|---|
| $LD_{50}$ | orl - rat | 28000 | mg/kg |
| $LD_{50}$ | ipr - mus | 99 | mg/kg |
| $LD_{50}$ | ivn - mus | 14 | mg/kg--. |

Column 6, after line 27 insert

--Sodium Borate ($Na_2B_2O_7$)

NIOSH #: VZ 2240000

Toxicity Data: N/A

TLV: Air img/$m^3$

DTLVS: 4,46,80

THR: Moderate

LD (man) = 200 mg/kg--.

UNITED STATES PATENT AND TRADEMARK OFFICE

CERTIFICATE OF CORRECTION

PATENT NO. : 4,961,865
DATED : October 9, 1990
INVENTOR(S) : Edmond R. J. Pennartz It is certified that error appears in the above-indentified patent and that said Letters Patent is hereby corrected as shown below:

Column 6, line 50, delete the first "parenthesis".

Column 7, line 3, change "(Ultraflex)" to --(Ultraflamex)--.
Column 7, line 11, change "merex" to --Amerex --.
Column 7, line 21, change "60mmX40mmX100mm," to --600mmX400mmX100mm, --.
Column 7, line 26, after "above" insert a --parenthesis --.
Column 7, line 33, change "TIMER" to --TIMBER--.
Column 7, line 43, insert --Significant events during the test: --.
Column 10, line 18, change "position" to --composition --.

Signed and Sealed this

Fifth Day of July, 1994

Bruce Lehman

*Attest:*

BRUCE LEHMAN

*Attesting Officer*

*Commissioner of Patents and Trademarks*